US005950849A

United States Patent [19]

Ekkert et al.

[11] Patent Number: 5,950,849

[45] **Date of Patent: *Sep. 14, 1999**

[54] CONTAINER CLOSURE WITH RIBBED ENLARGED GRASPING REGION

[75] Inventors: Len Ekkert, Lemont; Jeffrey F. Ullrich, Western Springs, both of Ill.

[73] Assignee: Phoenix Closures, Inc., Naperville, Ill.

[ * ] Notice: This patent is subject to a terminal disclaimer.

[21] Appl. No.: 08/854,574

[22] Filed: May 12, 1997

[51] Int. Cl.[6] ..... B65D 41/00

[52] U.S. Cl. ..... 215/252; 215/296; 215/320; 215/329; 215/344; 215/354; 215/44; 215/45

[58] Field of Search ..... 215/252, 295, 215/296, 316, 320, 321, 329, 330, 331, 341, 344, 354, 318, 45, 44

[56] References Cited

U.S. PATENT DOCUMENTS

| | | | |
|---|---|---|---|
| D. 369,748 | 5/1996 | Zemlo et al. . | |
| D. 370,631 | 6/1996 | Zemlo et al. . | |
| D. 371,074 | 6/1996 | Zemlo et al. . | |
| 3,455,478 | 7/1969 | Fields et al. . | |
| 4,156,490 | 5/1979 | Peraboni . | |
| 4,343,408 | 8/1982 | Csaszar . | |
| 4,352,436 | 10/1982 | Chartier et al. . | |
| 4,432,461 | 2/1984 | Mumford et al. . | |
| 4,436,212 | 3/1984 | Alejandro Llera . | |
| 4,461,390 | 7/1984 | Csaszar . | |
| 4,479,586 | 10/1984 | Csaszar . | |
| 4,549,667 | 10/1985 | Dullabaun . | |
| 4,567,993 | 2/1986 | Albrecht et al. . | |
| 4,613,052 | 9/1986 | Gregory et al. . | |
| 4,669,623 | 6/1987 | Csaszar . | |
| 4,699,287 | 10/1987 | Bullock | 215/321 X |
| 4,756,438 | 7/1988 | Ryder . | |
| 4,807,771 | 2/1989 | Roy et al. . | |
| 4,895,265 | 1/1990 | Luch et al. | 215/44 X |
| 4,907,708 | 3/1990 | Csaszar | 215/252 |
| 4,919,285 | 4/1990 | Roof et al. . | |
| 4,978,016 | 12/1990 | Hayes . | |
| 5,092,478 | 3/1992 | La Pierre . | |
| 5,135,123 | 8/1992 | Nairn et al. . | |
| 5,137,163 | 8/1992 | Moore . | |
| 5,450,972 | 9/1995 | Zemlo | 215/252 |
| 5,755,346 | 5/1998 | Ekkert | 215/252 |

OTHER PUBLICATIONS

Documents identified as A1–A3 are photocopies of illustrations of closures that were publically known prior to the filing date of the present application.

Documents identified as B–1–B4 are photocopies of a closure and an illustration of a closure that is the subject of U.S. Trademark Application Serial No. 75/025,995, which application was filed on Dec. 1, 1995, and for which a date of first use was claimed as Aug. 2, 1995.

*Primary Examiner*—Stephen K. Cronin
*Assistant Examiner*—Robin A. Hylton
*Attorney, Agent, or Firm*—Welsh & Katz, Ltd.

[57] ABSTRACT

A tamper-indicating closure is used with an associated container having a finish having an external thread formation thereon, and an annular locking ring located axially under the thread formation. The closure includes a closure cap having a circular top wall portion defining an outermost edge and a top wall extension region. The closure cap includes an annular skirt portion depending from the top wall portion inwardly of the outermost edge. An internal thread is formed in the skirt and defines a skirt wall plane. The closure includes a plurality of ribs extending from the top wall extension region to define an enlarged grasping region to comfortably fit a user's hand. An annular tamper-indicating band depends from the cap and is detachably connected to the cap by a plurality of circumferentially spaced, frangible connectors extending between the band and at least some of the ribs. The band includes an internal surface configured for engaging the locking ring and separates the band from the skirt portion. The band depends from the cap so that the entirety of the band is outwardly displaced from the skirt wall plane. The band is sufficiently radially spaced from the skirt wall plane such that in initial engagement of the closure with the container the band minimally, if at all, contacts the container thread formation.

5 Claims, 3 Drawing Sheets

CONTAINER CLOSURE WITH RIBBED ENLARGED GRASPING REGION

FIELD OF THE INVENTION

This invention relates to a container closure having an enlarged grasping area. More particularly, the invention relates to a tamper-indicating container closure having an enlarged grasping area to facilitate removing the closure from the container and having a tamper-evident band that is outwardly, radially displaced from the closure skirt.

BACKGROUND OF THE INVENTION

Container closures, and more specifically, tamper-indicating or tamper-evident closures are well known in the art. In a typical arrangement, a threaded container includes a locking ring, or like annular projection extending from the container finish, adjacent to and below the container threaded portion.

Consumers will readily recognize that such closures are used for sealing containers of all types, including juice containers, milk containers and the like. Those skilled in the art will recognize that such liquids have differing viscosities and may be best packaged in containers having different opening or dispensing sizes. In application, for example, some types of liquid foods may be best packaged in a container that has a relatively small dispensing opening that provides for directed pouring.

A closure which is fitted to the container includes a plastic closure cap having a circular top wall portion and a depending annular skirt portion. The skirt portion has an internal thread configured to threadedly engage the container thread. Tamper indication is provided by a separable band which extends and depends from the skirt portion. The band engages the locking ring and separates from the skirt portion as the closure is removed from the container. The band includes bridge-like connectors which extend between the skirt portion and the band that break as the closure is removed from the container. Exemplary of such a closure is that disclosed in U.S. Pat. No. 5,450,972 to Zemlo, which patent is commonly assigned herewith, and is incorporated herein by reference.

Closures can have a wide variety of diameters. Some caps are sufficiently large to grasp to turn the closure to remove it from the container. Others could prove problematic for some individuals. This is particularly true if there is a relatively strong seal between the closure and the container.

In one known tamper-indicating closure, the separable band includes a cam-like projection which extends inwardly from an inner surface of the band. The cam coacts with the locking ring and provides resistance during removal of the closure. As the closure is rotated off the container and the locking ring and cam engage one another, the bridge-like connectors yield and the band separates from the closure skirt portion.

Other known tamper-indicating band configurations include wings or tabs formed as part of the band that are adapted to coact with the container locking ring. Upon commencing removal of the closure from the container, the wings or tabs flex and engage the locking ring. The tabs or wings provide sufficient resistance to overcome the yield strength of the connectors.

Currently known tamper-indicating closure configurations work well to accomplish their intended objective, i.e., to provide visibly discernible evidence of tampering. However, such configurations may prove to be troublesome when initially applying the closure to the container. In particular, it has been observed that one or more of the bridge connectors of tamper-indicating bands of prior art closures may separate from the skirt portion as the closure is applied to the container. In some instances, this can be due to contact between the band and the container threads. Breaking of these connectors during application could thus place an otherwise untampered container in an apparent tampered condition due to unintentional band separation and tamper indication.

Accordingly, there continues to be a need for a closure having an enlarged grasping area and including a tamper-indicating band which facilitates readily engaging the closure with the container without risk of the band separating from the closure upon such initial engagement. Such an arrangement permits use of the closure with a container having a relatively narrow neck portion to provide directed pouring.

SUMMARY OF THE INVENTION

A tamper-indicating closure for use with an associated container is disclosed. The associated container has a finish having an external thread formation thereon, and includes an annular locking ring located axially under the thread formation.

The closure includes a closure cap having a circular top wall portion defining an outermost edge and a top wall extension region. The closure cap includes a depending annular skirt portion depending from the top wall portion inwardly of the outermost edge. An internal thread is formed in the skirt and defines a skirt wall plane. The thread is adapted to threadedly engage the container thread formation to engage the closure with the container.

The closure includes a plurality of fin-like elements or ribs extending from the top wall extension region to define an enlarged grasping region. The ribs of the enlarged grasping region can be arcuately shaped, or curved, to facilitate, in part, readily grasping the closure to remove it from the container. The curved ribs provide a comfortable fit for a user's hand. Moreover, the ribbed configuration reduces the amount of material required to manufacture the closure and thus reduces the overall weight and material cost of the closure.

In one embodiment, the ribs are parallel to one another and at least some of the ribs extend between the extension region and the skirt portion. Alternately, the ribs can be radially oriented relative to the top wall, and can extend between the extension region and the skirt portion.

The closure further includes an annular tamper-indicating band depending from the cap. The band is detachably connected to the cap by a plurality of circumferentially spaced, frangible connectors extending between the band and at least some of the ribs. The band includes an internal surface configured for engaging the locking ring for separating the band from the skirt portion. The band depends from the cap so that the entirety of the band is outwardly displaced from the skirt wall plane.

The band can include an internal camming surface having first and second axially spaced apart, inwardly extending camming projections. The camming projections can be configured so that they have successively larger diameters.

The band is sufficiently radially spaced from the skirt wall plane such that the band minimally, if at all, contacts the container thread formation when the closure is initially engaged with the container. In a preferred embodiment, the band does not contact the container thread formation when the closure is initially positioned on the container. In this manner, the opportunity for inadvertently breaking one or more of the connectors upon initial engagement of the closure with the container is greatly reduced or eliminated.

The closure can include an annular, inner depending plug portion depending from the top wall inwardly of the skirt. The plug enhances the seal between the container contents and the environs.

Other features and advantages of the present invention will be apparent from the following detailed description, the accompanying drawings, and the appended claims.

DETAILED DESCRIPTION OF THE PREFERRED EMBODIMENTS

Figure 1:
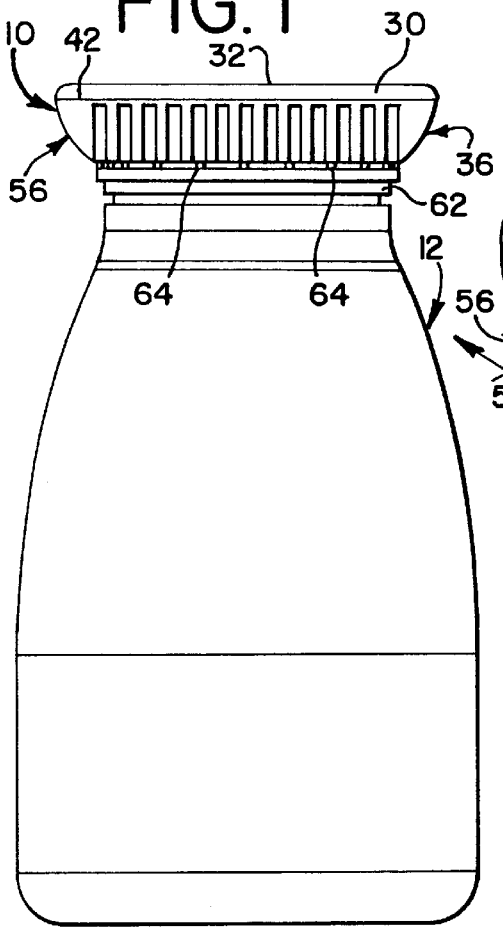
FIG. 1 is a front view of a container having a tamper-indicating closure with an enlarged grasping area engaged therewith, the closure embodying the principles of the present invention.
Figure 2:
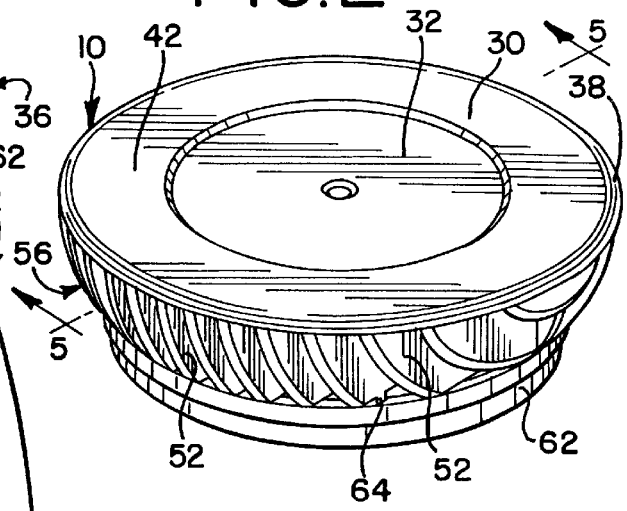
FIG. 2 is perspective view of the tamper-indicating closure illustrated in FIG. 1.
Figure 3:
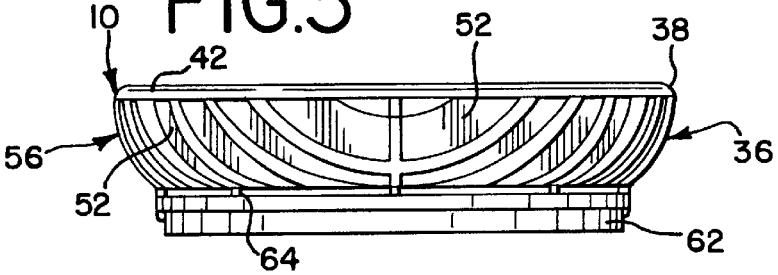
FIG. 3 is a side view of the closure of FIG. 2, illustrated from the right-hand side thereof.
Figure 4:
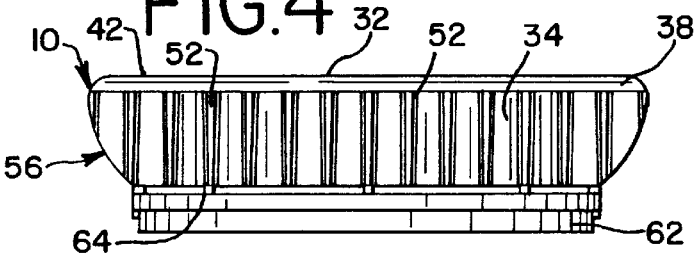
FIG. 4 is a side view of the closure of FIG. 2 illustrated from the left-hand side thereof.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 6:
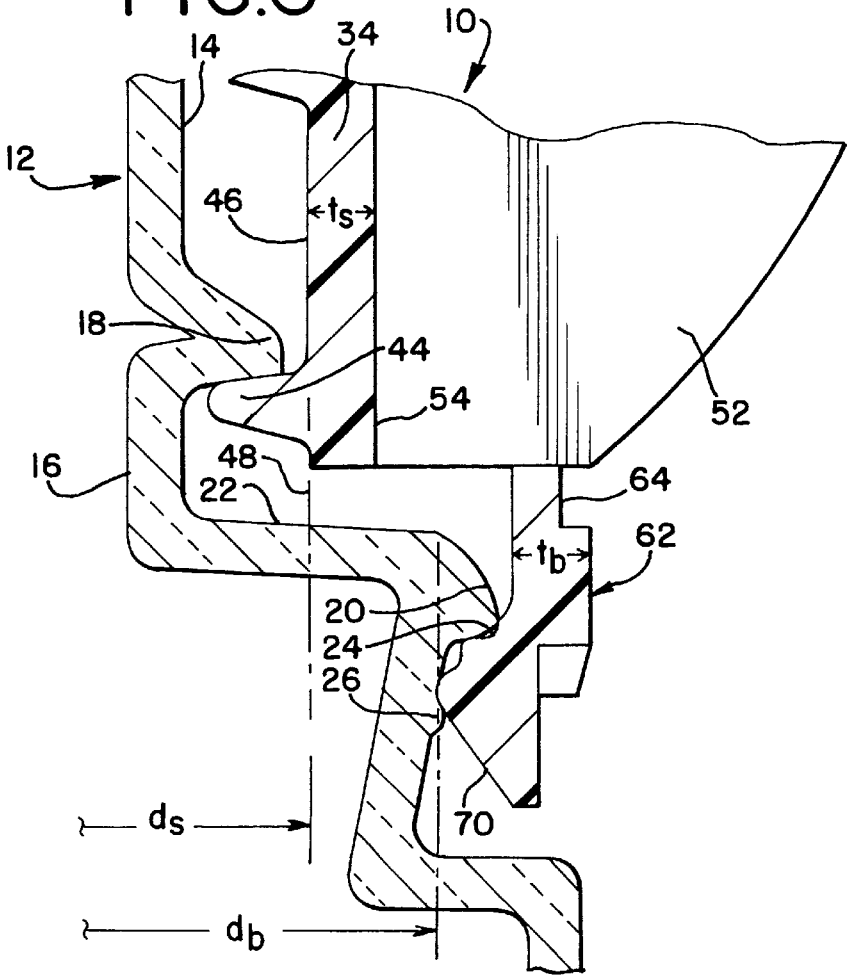
FIG. 6 is an enlarged partial cross-sectional view of the closure as indicated in FIG. 5, the closure being illustrated with a portion of the container finish with which the closure is engaged.

Referring now to the figures, and in particular to FIGS. 1–4, there is shown a tamper-indicating closure 10 in accordance with the principles of the present invention. The closure 10 is illustrated engaged with a container 12 that may contain, for example, milk. Referring now to FIG. 6, which illustrates the closure 10 and a portion of the container 12 with which the closure 10 is engaged, the container 12 includes a finish portion 14 which is that portion of the container neck 16 that engages the closure 10.

The container finish 14 includes a thread formation 18 thereon and includes a locking or interference ring 20 disposed on the container 12, below the container threads 18. As illustrated, the locking ring 20 can extend from a shoulder 22 formed in the container 12 below the threads 18. The ring 20 can include a lip-like element 24 extending therefrom that is adapted to engage the closure 10. The container 12 can include a raised bead-like stop element 26 disposed below the ring 20. As will be described in more detail herein, the stop element 26, in part, prevents over-engagement of the closure 10 with the container 12.

The closure 10 includes a cap 30 having a top wall portion 32 and a depending skirt portion 34 depending from the top wall portion 32. The top wall portion 32 is generally circular, and unlike commonly known closure caps, includes an over-sized or enlarged top which provides an enlarged grasping area as illustrated at 36. An outermost edge 38 is defined by the periphery of the top wall portion 32.

Figure 5:
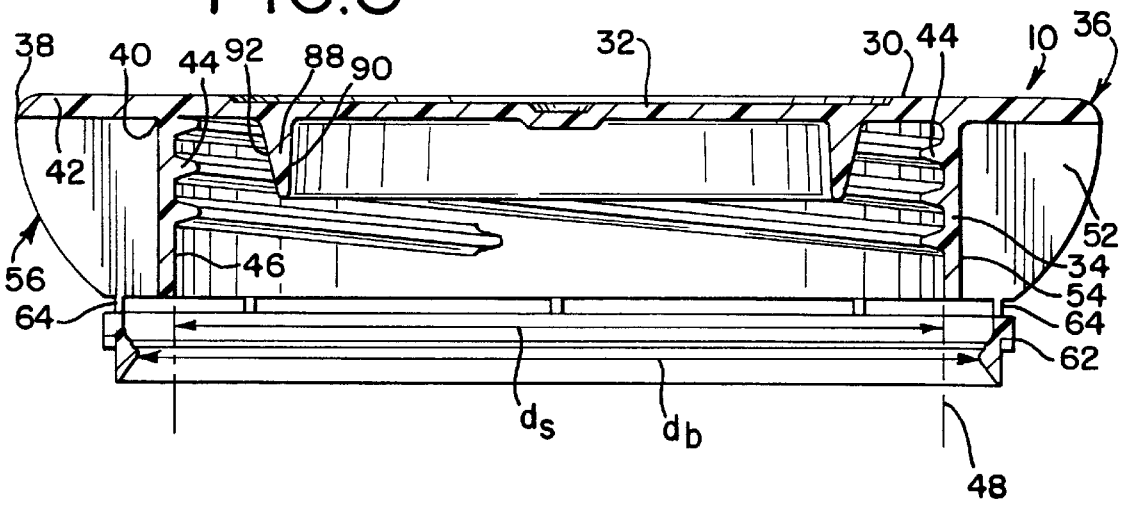
FIG. 5 is a cross-sectional view of the closure of FIG. 2 taken along line 5—5 thereof.

Referring to FIG. 5, the depending skirt portion 34 depends from the top wall portion 32 inwardly of the outermost edge 38. The portion of the top wall 32 outward of the top wall-skirt juncture, as illustrated at 40, defines a top wall extension region 42. The skirt portion 34 includes an internal thread 44 formed therein for engaging the container threads 18. The inner wall 46 of the skirt 34, from which the thread formation 44 extends, defines a skirt wall plane as indicated by the arrow at 48. The plane 48 extends generally perpendicular to the cap top wall 32.

The cap 30 includes a plurality of fin-like elements or ribs 52, at least some of which extend between the top wall portion 32, at about the extension region 42, and an outer wall 54 of the depending skirt 34. The ribs 52 define the grasping region 36 to facilitate, in part, readily grasping the closure 10 for turning the closure 10 to remove it from the container 12. Preferably, the ribs 52 have a curved or arcuate shape as illustrated at 56, curving downwardly and inwardly toward the skirt 34, to comfortably fit a user's hand. The ribbed configuration also reduces the amount of material required to manufacture the closure 10, and thus reduces the overall weight and the material cost of the closure 10.

Figure 9:
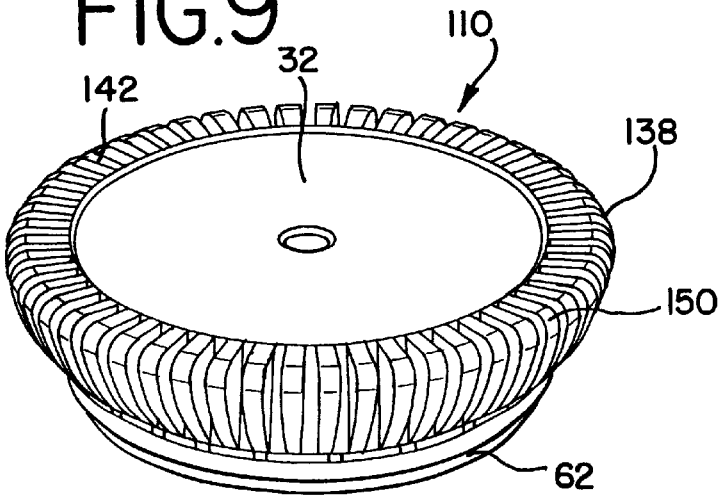
FIG. 9 is a perspective view of an alternate embodiment of the tamper-indicating closure having an enlarged grasping area, and having radially oriented ribs.

In a current embodiment, the ribs 52 are parallel to one another, as illustrated in the closure shown in FIGS. 1–4. Alternately, the ribs 150 can be radially oriented, as illustrated in the embodiment of the closure 110 as shown on FIG. 7, with the extension region 142 and optionally the outermost edge 138 formed by a portion of the ribs 150. It will of course be recognized by those skilled in the art that the top wall portion 32 can be formed as a solid member or element extending from that portion of the cap over the skirt 34 as illustrated in the embodiment 10 of FIGS. 1–4, with the ribs radially oriented as shown in FIG. 9. That is, the closure 10 can be formed with the ribs extending radially from the top wall portion, without an undercut.

Referring now to FIGS. 5–8, the closure 10 includes a tamper-evident or tamper-indicating band 62 that depends from the cap 30. The band 62 is configured to provide visibly discernible evidence that the closure 10 has been removed from the container 12, that the container 12 may have been opened or that the contents may have been otherwise tampered with.

The tamper-evident band 62 depends from the cap 30 and is connected thereto by a plurality of circumferentially spaced bridge-like connectors 64. The connectors 64 have a length $l_b$, and extend between the band 62 and at least some of the ribs 52. As best seen in FIGS. 5–6, the band 62 is connected to the cap 30 such that the entirety of the band 62 is outwardly displaced from the skirt wall plane 48. Essentially, the band 62 lies in a different plane than, and is thus non-coplanar with the skirt wall plane 48.

In a preferred embodiment, the thickness $t_b$ of the band 62 is substantially greater than the thickness $t_s$ of the skirt 34. In a current embodiment, the band thickness $t_b$ is about 150 percent of the thickness $t_s$ of the skirt wall; that is, the band 62 has a thickness $t_b$ of about 0.045 inches, and the skirt wall 34 has a thickness $t_s$ of about 0.030 inches. As is readily apparent, in this configuration, an innermost periphery of the band 62 has a diameter $d_b$ that is substantially greater than the diameter $d_s$ across the skirt wall plane 48.

The radially spaced relationship between the band 62 and the skirt 34 provides a number of advantages. For example, when the closure 10 is initially engaged with the container 12, as is discussed in detail herein, the band 62 does not contact or minimally contacts the container threads 18, thus reducing the opportunity for inadvertently breaking any of the connectors 64 during initial engagement of the closure 10 and the container 12. In addition, the spaced relationship between the skirt wall plane 48 and the band 62 minimizes the dependence of band 62 design on the skirt wall plane 48, skirt diameter and skirt design because of the spaced relationship and non-coplanar relationship between the band 62 and the skirt 34. With the band 62 configuration minimally dependent upon the skirt wall diameter, more efficient, less breakage prone connections between the skirt 34 and band 62 can be used.

The connectors 64, which are substantially thinner than the band 62 adjacent thereto, are frangible connections which break or yield as the closure 10 is twisted or threadedly disengaged from the container 12 and as the band 62 is urged outwardly and downwardly from the closure 10.

In one embodiment, the tamper-evident band 62 includes first and second camming projections 66, 68, respectively on an inside surface 74 thereof. The dual camming projections 66, 68 permit initial placement of the closure 10 onto the container 12, while reducing or eliminating the possibility that one or more of the connectors 64 will break, and that the band 62 will separate from the cap 30 as the closure 10 is applied to the container 12. The projections 66, 68 are further adapted to facilitate separation of the band 62 from the skirt portion 34 as the closure 10 is removed from the container 12, to provide tamper indication.

As best seen in FIG. 6, the first camming projection 66 extends inwardly of the band 62 a distance greater than the second camming projection 68. The first camming projection 66 can include an inclined or ramped surface 70 extending from about the end of the band 62, upward to about the peak 72 of the projection 68. The inclined surface 70 facilitates initial application of the closure 10 to the container 12.

The second camming projection 68 is recessed relative to the first projection 66. The second projection 68 extends inwardly of the band 62 a distance less than the first projection 66, and a distance greater than the inside surface 74 of the band 62. Thus, the second camming projection 68 defines an intermediate position relative to the inside surface 74 and the first camming projection 66. Those skilled in the art will recognize that a wide variety of band 62 and projection 66, 68 arrangements can be used with the present closure 10. Such other band 62 and projection 66, 68 arrangements are within the scope of the present invention.

Each of the camming projections 66, 68 includes an upper base portion, a peak and a lower base portion, 76, 72, 78 and 80, 82, 84, respectively for the first and second projections 66, 68. The peaks 72, 82, which define the inwardly most extending portion of their respective projections 66, 68 are curved or arcuate surfaces.

Figure 7:
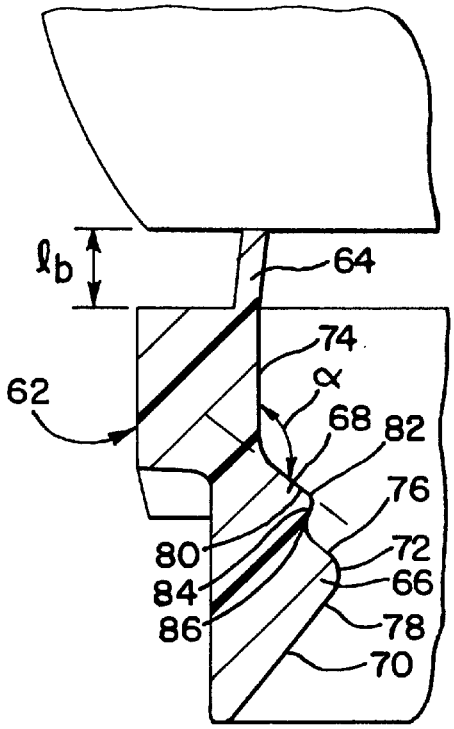
FIG. 7 is an enlarged, partial cross-sectional view of an exemplary tamper-indicating band configured for use with the closure of the present invention.

The upper base portion 80 of the second projection 68 defines an angle $\alpha$ relative to the inside wall 74. As best seen in FIG. 7, the upper base portion 80 is at an angle $\alpha$ of about 131° relative to the inside wall 74. The lower base portion 84 of the second projection 68 and the upper base portion 76 of the first projection 66 define a transition region 86. In a preferred embodiment, the transition region 86 defines an arcuate or curved surface.

Figure 8:
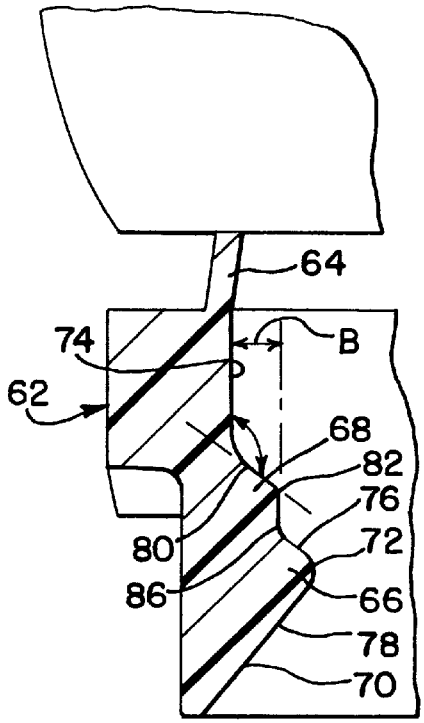
FIG. 8 is an enlarged, partial cross-sectional view of an alternate tamper-indicating band configured for use with the closure of the present invention.

In a preferred embodiment, the second projection lower base portion 84, between the peak 82 and the transition region 86 is arcuate, i.e., concave, relative to the projections 66, 68. Alternately, as shown in FIG. 8, the lower base portion 84 may be a planar surface formed at an angle $\beta$ relative to the inside wall 74.

It will be recognized by those skilled in the art that the above-noted angles are exemplary only. Various cap sizes may require different angles between the physical features of the closure.

As will be apparent from the figures, as the closure 10 is applied to the container 12, the band 62 readily passes over the container threads 18 with minimal, if any contact therebetween. It is contemplated that a conventional capping method will be used to initially engage the closure 10 to the container 12. Thus, the method would comprise screwing the closure 10 onto the container 12 whereby the closure threads 44 engage the container threads 18 while the band 62 slides down and over the locking ring 20.

As the band 62 slides over the ring 20, the first camming projection 66 is forced over the ring 20 and urges the band 62 outwardly. As the first camming projection 66 passes over and beyond the ring 20, the second camming projection 68 precludes an excessive inward and downward snap-back action of the band 62 by engaging the ring 20. The snap-back effect has been observed to break connectors on some known closures. Thus, the second projection 68 dampens and reduces the snap-back effect and produces a two-stage return of the band 62 to its non-stressed, pre-application state, with the band 62 disposed below the ring 20.

When the closure 10 is fully engaged with the container 12, the first camming projection 66 comes to rest on the bead-like stop element 26. Essentially, the stop element 26 prevents over-engagement of the closure 10 with the container 12. As is readily apparent from FIG. 6, engagement of the first camming projection 66 and the stop element 26 prevent excessive contact, and preferably any contact, between the skirt 34 or ribs 52 and the interference ring 20.

The closure 10 is then fully applied to the container 12, and the band 62 comes to rest with the first camming projection 66 between the interference ring 20 and the stop element 26.

It has been observed that the two-stage return of the band 62 to its non-stressed state reduces the opportunity for, and may preclude inadvertently breaking the connectors 64 which can otherwise result from the snap-back action. The snap-back action has been observed to produce axial and radial stresses in the connectors 64, other than the stresses which result from the outward urging of the band 62 relative to the cap 30 during application. These additional axial and radial stresses could result in tearing the connectors 64 in either or both the radial and axial directions as the closure 10 is applied to the container 12.

The dual camming projections 66, 68 reduce the opportunity for tearing of the connectors 64. The projections 66, 68 produce a two-step damping effect which reduces the stresses resulting from snap-back. The reduced stresses in turn reduce the opportunity for yielding of the connectors 64.

When it is desired to access the contents of the container 12 and to remove the closure 10, the closure 10 is grasped about the gasping region 36 and the closure 10 is twisted off.

As twisting torque is applied to remove the cap 30, the second camming projection 68 contacts and engages the interference ring 20, which urges the band 62 outward. Continued twisting of the closure 10 contacts the first camming projection 66 with the interference ring 20 which urges the band 62 further outward.

As the closure 10 is rotated further along the container threads 18, the upward force translated from the twisting motion, along with the outward urging of the band 62 creates a tearing or severing force on each of the connectors 64, which breaks the connectors 64. The connectors 64 may break in a sequential manner. The tearing force is a result of the cap 30 being forced upward relative to the container 12, while the band 62 is obstructed from upward movement due to the contact between the interference ring 20 and the camming projections 66, 68.

It will be recognized by those skilled in the art that the camming projections 66, 68 need not be continuous circumferential elements, but can be formed as a plurality or series of independent projections extending inwardly from the inside surface 74 of the band 62.

As can be seen from FIG. 6, after the band 62 has been fully separated from the cap 30, the band 62 will rest on the container 12 between the shoulder 22 and the stop element 26. Essentially, engagement of the first projection 66 with the stop element 26 prevents the band 62 from slipping downward along the container 12 after the band 62 is separated from the closure 10, i.e., after initial removal of the closure 10 from the container 12. Thus, the band is retained in place near the top of the container 12 at about the shoulder 22 and is prevented from slipping down the container 12 to possibly interfere with a user's handling of the container 12.

As is best seen in FIG. 5, the closure 10 may also include a plug 88 that depends from the top wall 32, annularly disposed relative to the skirt 34. The plug 88 has an inner surface 90 and an outer surface 92. The outer surface 92 is configured to engage the container neck 16 at about the inner surface thereof, such that the container neck 16 is positioned between the plug 88 and the skirt 34 when the closure 10 is engaged with the container 12. The plug 88 enhances the seal between the container 12 contents and the environs.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A tamper-indicating closure and container package comprising:

a container having a finish portion formed on a neck thereof, said finish portion including an external thread formation thereon and having an annular locking ring disposed on said container below said thread formation; and a closure cap having a circular top wall portion and an annular skirt portion depending from said top wall portion, said top wall portion defining an outermost edge and a top wall extension region extending outwardly from a juncture of said top wall portion and said skirt portion, said skirt portion having an internal thread formed therein and defining a skirt wall plane, said thread being threadedly engageable with said container thread formation, said closure including a plurality of ribs extending from said top wall extension region, at least some of said ribs extending between said extension region and said skirt portion, and including an annular tamper-indicating band depending from said cap and being detachably connected to said cap by a plurality of circumferentially spaced, frangible connectors, said band including an internal surface configured for engaging said locking ring and separating said band from said skirt portion, said band depending from said cap at a plurality of points outwardly spaced from said skirt portion and being, in its entirety, outwardly spaced from said skirt wall plane so that when said closure is applied to said container, said tamper-indicating band does not contact said thread formation on said container finish.

2. The tamper-indicating closure and container package in accordance with claim 1, wherein said container includes a stop element disposed thereon below said locking ring, and wherein a portion of said band internal surface is engageable with said container between said locking ring and said stop element when said closure is engaged with said container.

3. The tamper-indicating closure and container package in accordance with claim 1, wherein said cap includes an annular, inner depending plug portion depending from said top wall portion inwardly of said skirt portion, said plug being engageable with said container to form a seal therebetween.

4. The tamper-indicating closure and container package in accordance with claim 1, wherein said band is sufficiently radially spaced from said skirt wall plane such that said band does not contact said container thread formation when said closure is initially engaged with said container.

5. The tamper-indicating closure and container package in accordance with claim 2, wherein said tamper-indicating band includes an internal camming surface having first and second axially spaced apart, inwardly extending camming projections extending inwardly therefrom, said first and second camming projections being of successively larger diameters, and wherein said first camming projection is positioned between said locking ring and said stop element when said closure is engaged with said container.

* * * * *